United States Patent [19]

Ogata

[11] 4,199,830

[45] Apr. 29, 1980

[54] HOLDING APPLIANCE FOR USE IN A BLANKET OR A COVERLET AND THE LIKE

[76] Inventor: Yoshie Ogata, 10-4, 4 chome, Nishiochiai Sinjuku-ku, Tokyo, Japan

[21] Appl. No.: 938,532

[22] Filed: Aug. 31, 1978

[51] Int. Cl.[2] ..... A47C 21/02

[52] U.S. Cl. ..... 5/411; 5/498; 24/72.5

[58] Field of Search ..... 5/123, 127; 24/72.5, 24/73 A

[56] References Cited

U.S. PATENT DOCUMENTS

| | | | |
|---|---|---|---|
| 590,676 | 9/1897 | Bagley | 24/73 A |
| 1,071,764 | 9/1913 | Vowrimore | 5/122 |
| 2,931,084 | 4/1960 | DeWitt | 24/72.5 |
| 3,092,848 | 6/1963 | Gronvold | 5/320 |
| 3,350,726 | 11/1967 | Gardner | 5/322 |

*Primary Examiner*—Casmir A. Nunberg

*Attorney, Agent, or Firm*—Haseltine, Lake & Waters

[57] ABSTRACT

A holding appliance for use in a blanket or a coverlet and the like according to the present invention includes a band for fixing the blanket or the coverlet to a bed in such a manner that the blanket or the coverlet can be freely movable to some extent relative to the bed, thereby to prevent a wakeful condition which may occur due to a pressure on a body by the blanket or the coverlet.

6 Claims, 4 Drawing Figures

HOLDING APPLIANCE FOR USE IN A BLANKET OR A COVERLET AND THE LIKE

BACKGROUND OF THE INVENTION

The present invention relates to a holding appliance for use in a blanket or a coverlet and the like, and more particularly, to a holding appliance for preventing the blanket or the coverlet from falling down from a bed owing to the movement of a body of human being during sleeping.

Generally, human being moves around on a bed during sleeping. For this, a blanket or a coverlet frequently is apt to fall down from a bed. A continuation of sleeping in such a condition may result in catching a cold or falling an unexpected ill. Particularly, infants are subject to such a condition. It is further to be noted that it is difficult for a physically handicapped person to pick up a blanket or a coverlet fallen from a bed.

One way for removing disadvantages stated above is to fix the blanket or the coverlet to the bed by any suitable string. However, it is impossible to remove the drawbacks; such as, cutting of string due to the movement of a body during sleeping, wearing of the connecting portion between the string and the blanket or the coverlet, and existence of pressure on the body owing to the fact that the blanket or the coverlet is pulled by the string.

SUMMARY OF THE INVENTION

A first object of the present invention is to provide a holding appliance for use in a blanket or a coverlet and the like which can prevent the blanket or the coverlet from falling down from a bed due to the movement of a body.

A second object of the present invention is to provide a holding appliance for use in a blanket or a coverlet and the like which does not give a pressure to a body by loosely or softly holding the blanket or the coverlet.

A third object of the present invention is to provide a holding appliance for use in a blanket or a coverlet and the like which can prevent the wearing of the connecting portion between a connecting means and the blanket or the coverlet, or the cutting of the connecting means by connecting the blanket or the coverlet with the connecting means.

A fourth object of the present invention is to provide a holding appliance for use in a blanket or a coverlet and the like which can set the appliance to the coverlet by a relatively easy handling so as to prevent the falling of the blanket or the coverlet.

BRIEF DESCRIPTION OF THE DRAWINGS

Still another object, the feature and advantages of the present invention will become more apparent from the following detailed description taken in conjunction with the accompanying drawings, in which.

DETAILED DESCRIPTION OF PREFERRED EMBODIMENTS

Figure 1:
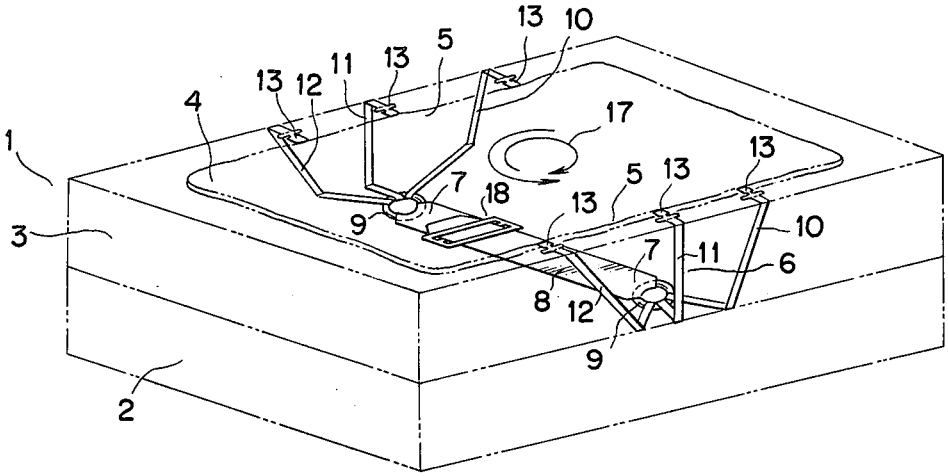
FIG. 1 is a perspective view which illustrates a preferred embodiment of a holding appliance for use in a blanket or a coverlet and the like according to the present invention, wherein the blanket or the coverlet is holded with the holding appliance.
Figure 2:
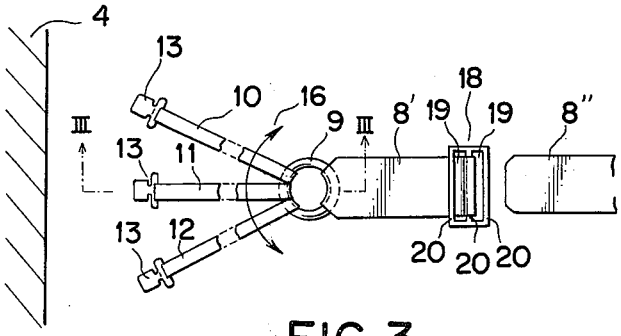
FIG. 2 is a plan view which illustrates a connecting relation between a band, a ring, and a supporter of a holding appliance employed in the present invention.
Figure 3:
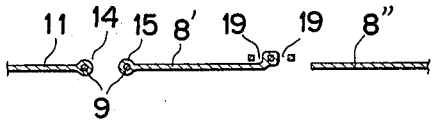
FIG. 3 is a cross sectional view taken in along III—III line of FIG. 2.

Referring to FIG. 1, a bed 1 comprises a base member 2 and a mattress 3 mounted on the base member 2 wherein human being lies the body on the mattress 3 to sleep. The body is covered with a blanket or a coverlet 4, the side 5 of which is holded by a holding device 6. The holding device 6 is disposed between the mattress 3 and the base member 2, wherein the device 6 comprises a belt-like shaped supporter 8 of cloth in such a manner that each side 7 of the supporter 8 is respectively positioned at each side 5 of the blanket or the coverlet 4, a ring 9 of plastics or metal provided at each side 7 of the supporter 8, a plurality of bands or straps 10, 11 and 12 of cloth each of which is connected to the ring 9 and is radially extending in parallel fashion, and a plurality of clips 13 provided at the free end of bands 10, 11, and 12. Referring to FIG. 2 illustrating a connecting structure between the ring 9, bands 10, 11 and 12, and the supporter 8, there are respectively provided with hollow portions at both the end 14 of bands 10, 11 and 12 and the end 15 of supporter 8 wherein the ring 9 can pass through the hollow portions. Accordingly, the bands 10, 11 and 12 can move relative to the supporter 8 in the direction of the arrow 16 with the ring 9 acting as the center of motion because of the fact that they are loosely fitted over the ring 9.

The supporter 8 is divided into two portions, each of which is connected by an adjustable backle 18. The backle 18 comprises three bridge members 20 and two openings 19 formed between thereof. One portion 8' of the supporter 8 is connected to the center bridge member 20 while the other portion 8'' of the supporter 8 can support via openings 19. Accordingly, with this backle 18 it is possible to adjust a whole length of the supporter 8.

With the holding device 6 employed in the present invention, following advantages will accrue.

a. Since the blanket or the coverlet is securely holded by the bands 10, 11 and 12, falling or drapping of the blanket or the coverlet from the bed is preferably prevented.

b. Since the band can be easily fixed to the blanket or the coverlet by handling the clips 13, it is possible to make it easy to hold the blanket or the coverlet.

c. An application of strong force to the band in the pulling direction thereof merely get the clip out of place, but does not make the band to be cut off and make the blanket or the coverlet to be worn out.

d. Since it is possible to freely move the band with the ring 9 acting as the center of motion, it is possible to put or hold a desirable position with the clip even in the event that the supporter 8 is obliquely set at a slightly different position with respect to the position shown in FIG. 1.

Figure 4:
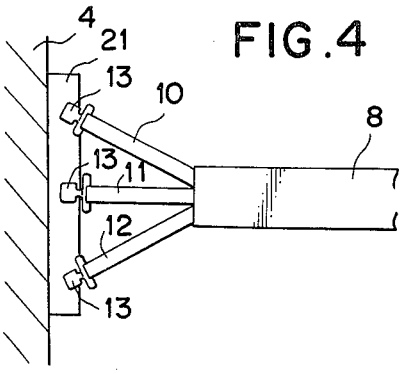
FIG. 4 is a plan view which illustrates a preferred another embodiment of a holding appliance for use in a blanket or a coverlet and the like according to the present invention.

Referring to FIG. 4 illustrating another embodiment of a holding appliance for use in a blanket or a coverlet and the like according to the present invention, this embodiment is characterized in that three bands 10, 11 and 12 are directly connected to the supporter 8 by removing the ring 9 as shown in FIG. 2 from the supporter 8, and in that a holding peace 21 provided at the side of the blanket or the coverlet is put or holded with the clip 13 to make it easy to hold the blanket or the coverlet. Provision of the backle 18 to the bands 11, 12 and 13, as another example of the present invention will make it possible to adjust the length of the bands. With this construction, the holding appliance of the present invention can apply to various size of beds and coverlets.

Moreover, it is possible to use the holding appliance in which the length of the bands 10 and 12 disposed at the both sides is longer than that of the center band 11. Thus, the bands 10 and 12 have a desirable loosening, when holding the blanket or the coverlet, to enable to softly hold it. Furthermore, an use of bands 10, 11 and 12 of elastic material, such as rubber, as still another example of the present invention, will make enable to softly hold the coverlet.

It is to be noted modification and variations of the embodiments of the invention disclosed herein may be resorted to without departing from the spirit of the invention and the scope of the appended claims.

What is claimed is:

1. An improved holder appliance for use in a blanket or the like disposed on a mattress having support means and a plurality of fastening means to fasten the blanket on the bed, wherein, the improvement comprises: a pair of supporter-straps having respective first ends connected with one another in alignment and laterally disposed between a base member and said mattress: connecting means fitted at said first end of one strap and adjustably engaged with an opposed end of said other strap; a plurality of bands radially extending from each other end of said supporter-strap; and a clip connected to the free end of said each band, for holding the side of said blanket.

2. A holding appliance as defined as claim 1, wherein: said each band is connected to said supporter through a ring in such a manner that said band is freely movable in the circumferential direction of said ring.

3. A holding appliance as defined in claim 1, wherein: the bands disposed outside, have a length longer than that of the other bands, to be loose when connecting the blanket with the bands.

4. A holding appliance as defined in claim 1, whrein: the band is formed of a rubber to impart elasticity.

5. A holding appliance as defined in claim 1, wherein: said supporter is provided with a suitable length-adjustable means.

6. A holding appliance as defined in claim 1, wherein: said band is provided with a suitable length-adjustable means.

* * * * *